US009470482B2

(12) United States Patent
Steil

(10) Patent No.: US 9,470,482 B2
(45) Date of Patent: Oct. 18, 2016

(54) REACTIVE TARGET SYSTEM

(71) Applicant: Everett McDowell Steil, Cumming, GA (US)

(72) Inventor: Everett McDowell Steil, Cumming, GA (US)

( * ) Notice: Subject to any disclaimer, the term of this patent is extended or adjusted under 35 U.S.C. 154(b) by 148 days.

(21) Appl. No.: 14/204,899

(22) Filed: Mar. 11, 2014

(65) Prior Publication Data

US 2015/0260487 A1 Sep. 17, 2015

(51) Int. Cl.
*F41J 7/04* (2006.01)
*F41J 5/14* (2006.01)
*F41J 1/10* (2006.01)

(52) U.S. Cl.
CPC .. *F41J 7/04* (2013.01); *F41J 5/14* (2013.01); *F41J 1/10* (2013.01)

(58) Field of Classification Search
CPC ..... F41J 7/04; F41J 7/00; F41J 7/06; F41J 1/10
USPC ..... 273/390–392, 406, 407
See application file for complete search history.

(56) References Cited

U.S. PATENT DOCUMENTS 1,865,988 A * 7/1932 Wiedeck ..... F41J 7/04 273/385
4,040,624 A * 8/1977 Lee ..... F41J 7/04 273/391
4,540,182 A * 9/1985 Clement ..... F41J 7/04 273/391
4,807,888 A * 2/1989 Pidde ..... F41J 7/04 273/392
5,232,227 A * 8/1993 Bateman ..... F41J 7/04 273/392
5,240,258 A * 8/1993 Bateman ..... F41J 7/04 273/392
5,433,451 A * 7/1995 De Vries ..... F41J 7/04 273/392
5,695,196 A * 12/1997 Yanosky ..... F41J 7/04 273/392
7,694,973 B1 * 4/2010 Hofmeister ..... F41J 7/06 273/391
7,731,197 B2 * 6/2010 Stutz ..... F41J 7/04 273/392
2008/0265511 A1 * 10/2008 Shum ..... F41J 7/06 273/392
2010/0032906 A1 * 2/2010 Wilcox ..... F41J 7/04 273/391
2011/0175293 A1 * 7/2011 Brune ..... F41J 7/04 273/406
2012/0205870 A1 * 8/2012 Saunders ..... F41J 7/04 273/392

* cited by examiner

*Primary Examiner* — Mark Graham
(74) *Attorney, Agent, or Firm* — Merchant & Gould, P.C.

(57) ABSTRACT

A target support system is used for supporting a target device for shooting practice. The target support system includes a target support frame, a target connecting mechanism, and a forward barrier. The target support frame is placed onto a target placement area. The target connecting mechanism is arranged on the target support frame and operatively supports a target device on the target support frame. The forward barrier protects the system from impact of a projectile on the system.

19 Claims, 17 Drawing Sheets

REACTIVE TARGET SYSTEM

BACKGROUND

Various types of targets are used to test shooting accuracy and build shooting skills. Examples of targets include gun targets, archery targets, pistol targets, hunting targets, and paper targets. Some targets are reset targets, which can be operated to pop up after the targets are hit by a bullet or arrow. Other targets are target plates, which can hang from an elevated position, such as a tree or hanging rack.

SUMMARY

In general terms, this disclosure is directed to a reactive target system. In one possible configuration and by non-limiting example, the target system includes a target support system and a target device. Various aspects are described in this disclosure, which include, but are not limited to, the following aspects.

One aspect is a target support system including a target support frame, a target connecting mechanism, and a forward barrier. The target support frame is configured to be placed onto a target placement area. The target connecting mechanism is arranged on the target support frame and operatively supports a target device on the target support frame. The forward barrier is configured to protect the system from impact of a projectile on the system.

Another aspect is a target system including a target support system and a target device. The target support system includes a target support frame configured to be placed onto a target placement area; a target connecting mechanism arranged on the target support frame and operatively supporting a target device on the target support frame; and a forward barrier protecting the system from impact of a projectile on the system. The target device includes a target area portion providing a target area at which a projectile is aimed; and a target engaging portion configured to be coupled to the target support frame; and a target reset mechanism configured to operatively couple the target engaging portion of the target device to the target connecting mechanism of the target support system.

Yet another aspect is a computer-readable storage medium containing software instructions that, when executed, cause a target system to: receive, by a target control system, a target reset command from a user, wherein the user inputs the target reset command through the target control device; transmit, by the target control system, the target reset command to a retention control system; operate, by the retention control system, a target retention mechanism to switch a target device from a lowered position to a raised position based upon the target reset command. The target device is raised to a substantially vertical position with respect to the target support system in the raised position. The target device is lowered to a substantially horizontal position with respect to the target support system in the lowered position.

DETAILED DESCRIPTION

Figure 1:
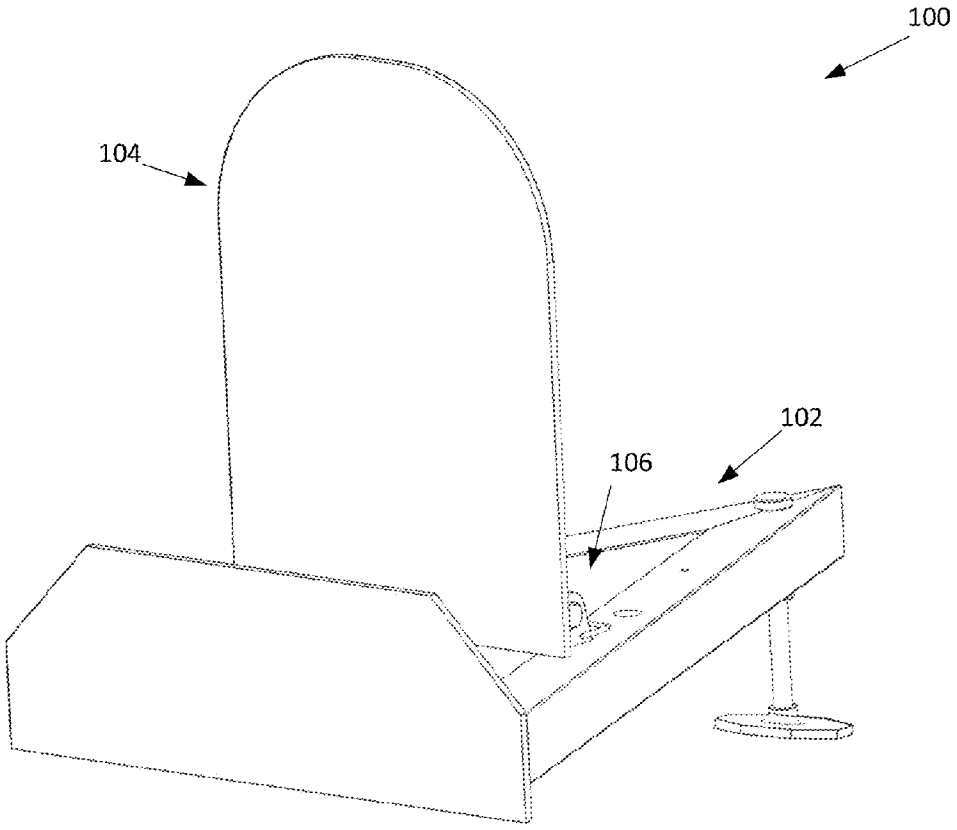
FIG. 1 is a perspective view of an example target system.

Various embodiments are described in detail herein with reference to the drawings, wherein like reference numerals represent like parts and assemblies throughout the several views. Reference to various embodiments does not limit the scope of the appended claims. Additionally, any examples set forth in this specification are not intended to be limiting and merely set forth some of the many possible embodiments for the appended claims.

FIG. 1 is a perspective view of an example target system 100, which includes a target support system 102, a target device 104, and a target reset mechanism 106. The target support system 102 operates to support the target device 104. In one or more embodiments, the target support 102 holds the target device 104 so that the target device 104 pivots with respect to the target support system 102. The target support system 102 is described in further detail with reference to FIGS. 2-5.

The target device 104 provides a target area configured to be hit by a projectile, such as a bullet, arrow, pellet, or other projection. The target device 104 is configured to be reactive when hit by a projectile to provide feedback to a shooter by visual and auditory responses. The target device 104 is described in further detail with reference to FIGS. 6-9.

The target reset mechanism 106 operates to connect the target device 104 to the target support system 102. In one or more embodiments, the target reset mechanism 106 permits the target device 104 to pivot with respect to the target support system 102 between a raised position and a lowered position. In the raised position, the target device 104 is raised to a substantially vertical position with respect to the target support system 102 and ready for shooting. In the lowered position, the target device 104 is laid flat and substantially horizontal with respect to the target support system 102, and thus may be effectively hidden from a shooter. The target reset mechanism 106 is described in further detail with reference to FIGS. 10-11.

Figure 2:
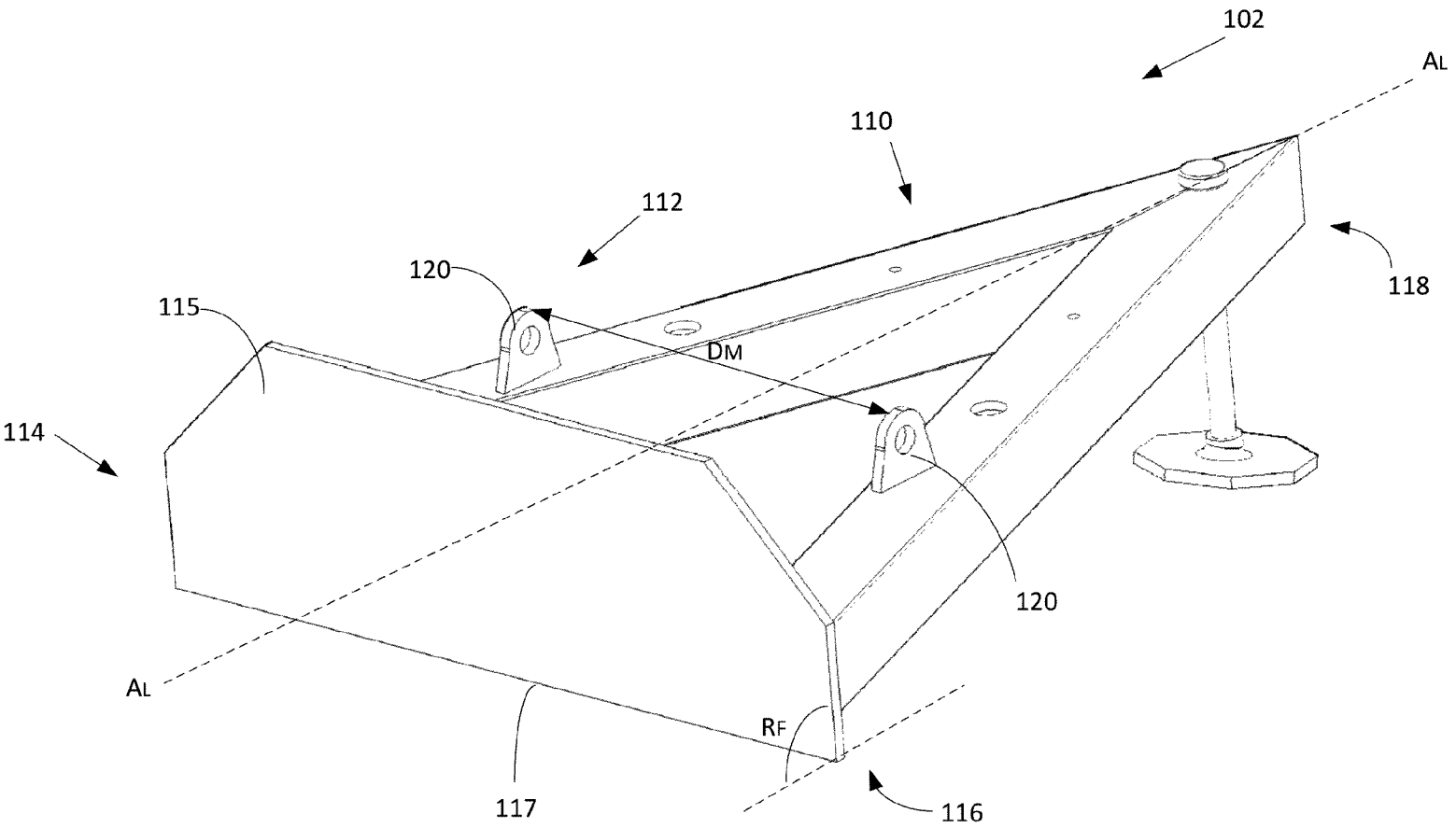
FIG. 2 is a front perspective view of an example target support system.

FIG. 2 is a front perspective view of the target support system 102 of FIG. 1. The target support system 102 has a forward end 116 and a rearward end 118. The target system 100 is arranged so that the forward end 116 of the target support system 102 faces projectiles coming toward the target system 100. The rearward end 118 is substantially opposite to the forward end 116 along a longitudinal axis $A_L$ of the target support system 102.

In one or more embodiments, the target support system 102 includes a target support frame 110, a target connecting mechanism 112, and a forward barrier 114.

The target support frame 110 is configured to be placed onto a target placement area. The target support frame 110 extends between the forward end 116 and the rearward end 118 along the longitudinal $A_L$. The target placement area can be on the ground, or any surfaces suitable for shooting practice with the target system 100. Such places include, but are not limited to, indoor or outdoor shooting ranges or sites for either recreational or military training purposes. The target support frame 110 is described in further detail with reference to FIGS. 4 and 5.

The target connecting mechanism 112 is configured to operatively support the target device 104 on the target support frame 110. The target connecting mechanism 112 is arranged on the target support frame 110. In one or more embodiments, the target connecting mechanism 112 includes at least one pivot portion configured to pivotally connect the target device 104 between the raised position and the lowered position thereof. In this example, the target connecting mechanism 112 is configured as a pair of male hinge flanges 120. In one or more embodiments, the pair of male hinge flanges 120 is attached on the target support frame 110 symmetrically with respect to the longitudinal axis $A_L$. The two male hinge flanges 120 are spaced apart at a distance $D_M$.

The forward barrier 114 operates to protect the target system 100 from impact of a projectile on the system 100, including both directed projectiles and ricochets. The forward barrier 114 is connected to the target support frame 110 at the forward end 116 of the target support system 102 and is dimensioned to at least partially cover the target reset mechanism 106, which includes the target connecting mechanism 112, from impact by a projectile. For example, the forward barrier 114 includes a protection plate 115 that is arranged to face projectiles traveling toward the system 100 and is large enough to hide the target reset mechanism 106 from the projectiles, whether the projectile is traveling directly from a shooter or is a ricochet.

In one or more embodiments, the forward barrier 114 is configured as part of the target support frame 110 and functions as a support for the target support system 102 on the target placement area. In particular, the forward barrier 114 supports the target support system 102 at the forward end 116 while the target support frame 110 is placed on the target placement area.

The forward barrier 114 has a bottom edge 117. In one or more embodiments, the bottom edge 117 forms a knife edge. The bottom edge 117 is configured to extend into the target placement area and engage with it to stabilize the target system 100 on the target placement area. As described below, the center of mass of the target system 100 is biased forwardly so that the weight of the target system 100 is focused down on the bottom edge 117, reducing the tendency for the target system 100 to twist or rotate when hit by projectiles.

In one or more embodiments, the forward barrier 114 is made from a metallic plate. One example of a metallic plate is an Abrasion Resistant (AR) steel plate. The metallic plate may provide abrasive resistance to the forward barrier 114, resulting in long service life under harsh conditions. The metallic plate may also comprise a relatively lightweight material that reduces the weight of the target system 100. Further, the metallic plate may be sufficiently resistant to impact and/or sliding contact. In one or more embodiments, the forward barrier 114 is made from AR steel, such as AR400, AR500, or AR600 steel.

Figure 3:
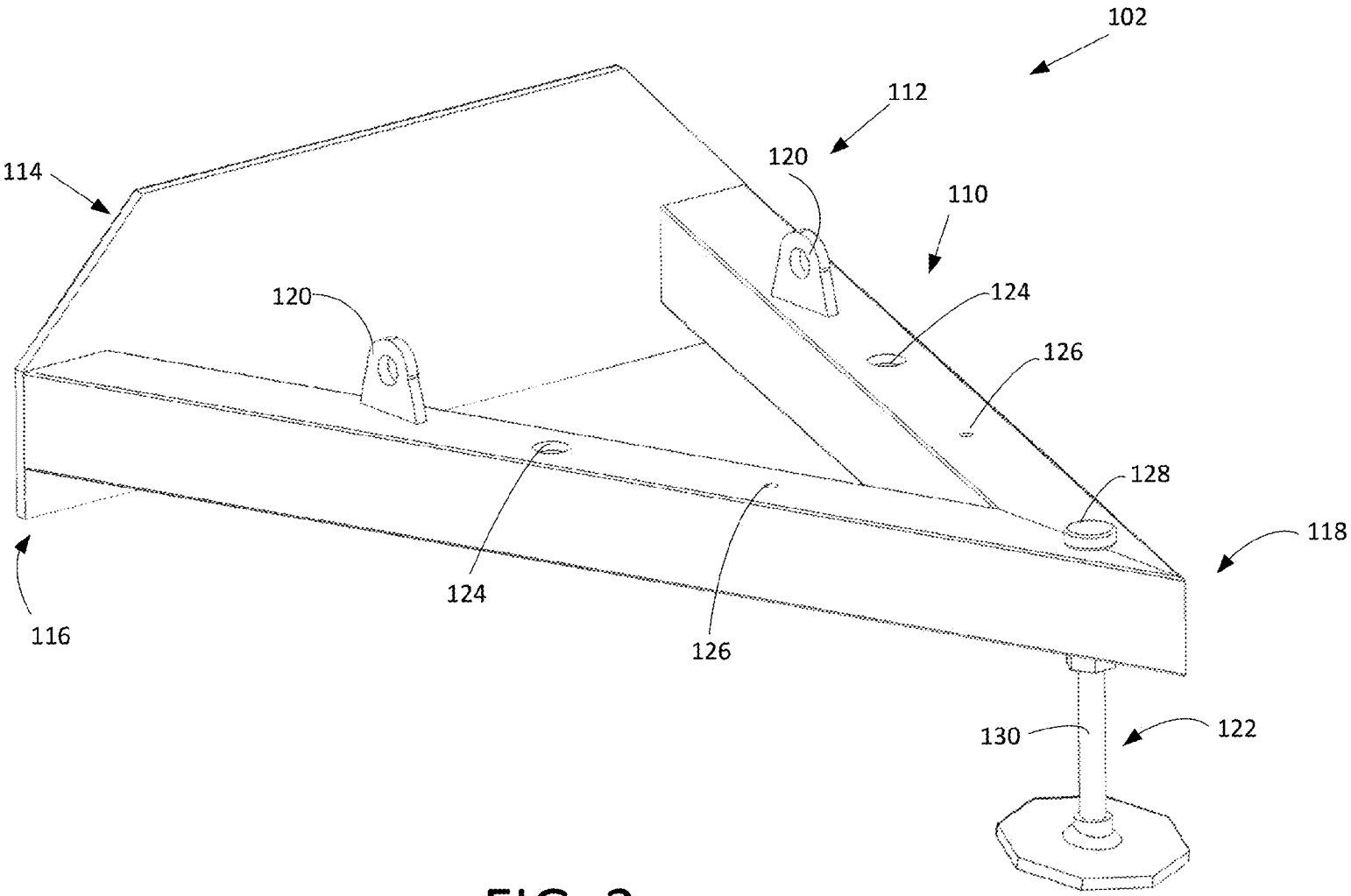
FIG. 3 is a rear perspective view of the target support system of FIG. 2.

FIG. 3 is a rear perspective view of the target support system 102 of FIG. 2. The target support system 102 further includes a leveling mechanism 122, a mounting mechanism 124, an accessory attachment mechanism 126, and a target damping mechanism 128.

The leveling mechanism 122 operates to support the target support frame 110 against the target placement area and adjust the target system 100 to be in an appropriate position. In particular, the leveling mechanism 122 allows the target system 100 to maintain stable position when placed on an uneven target placement area. Further, the leveling mechanism 122 operates to arrange the protection plate 115 to lean forward so that the forward barrier 114 forms an angle $R_F$ (FIG. 2) of less than 90 degrees with respect to the target placement area. In one or more embodiments, similarly to the forward barrier 114, this arrangement also allows the target device 104 to lean forward with respect to the target placement area. Such a forward-leaning structure of the target system 100 prevents the projectiles from spreading out in a larger area after hitting the target system 100 (either the front barrier 114 or the target device 104). The leveling mechanism 122 also operates to maintain the center of mass of the target system 100 close to the forward end 116 so as to remain the target system 100 balanced when projectiles hit on different spots of the target system 100.

The leveling mechanism 122 is arranged on the target support frame 110 adjacent the rearward end 118 so as to raise the target support frame 110 at the rearward end 118. The leveling mechanism 112 is preferably arranged on the longitudinal axis $A_L$ of the target support system 102 so as to be placed along the center line of the target support system 102. This arrangement assists the target system 100 in maintaining its balance. In one or more embodiments, the leveling mechanism 122 is configured as a level foot 130, which is described in further detail with reference to FIG. 5.

Some embodiments of the target support system 102 further include the mounting mechanism 124 configured to directly install the target support frame 110 onto the target placement area. The mounting mechanism 124 can replace the leveling mechanism 122 when the target system 100 is to be installed at one location and needs no portability. For example, when the mounting mechanism 124 is used to install the target support system 102 onto the target placement area, the leveling mechanism 122 need not be used to support the target support system 102 onto the target placement area. In one or more embodiments, the mounting mechanism 124 is configured as one or more through-holes, through which fasteners 125 (FIG. 5) pass into a predetermined target placement area.

In one or more embodiments, the target support system 102 further includes the accessory attachment mechanism 126 configured to install accessories to the target system 100. Once example of such accessories is a target retention mechanism 200 for selectively retain the target device 104 between the raised and lowered positions. The target retention mechanism 200 is described in further detail with reference to FIG. 12.

In one or more embodiments, the target support system 102 includes the target damping mechanism 128 configured to reduce collision impact and vibration caused by the target device 104 that moves from the raised position to the lowered position after hit by a projectile. When a projectile hits the target device 104, the target device 104 switches from the raised position to the lowered position and collides with the target support frame 110 by the impact from the projectile against the target device 104. The target mechanism 128 operates to reduce such collision impact that deteriorates stability of the target system 100 and reduces life service thereof.

In one or more embodiments, the target damping mechanism 128 is configured as a pad made from an elastic material such as rubber or plastic. Such a pad is inserted onto the target support frame 110 adjacent the rearward end 118 and replaceable as worn out.

Figure 4:
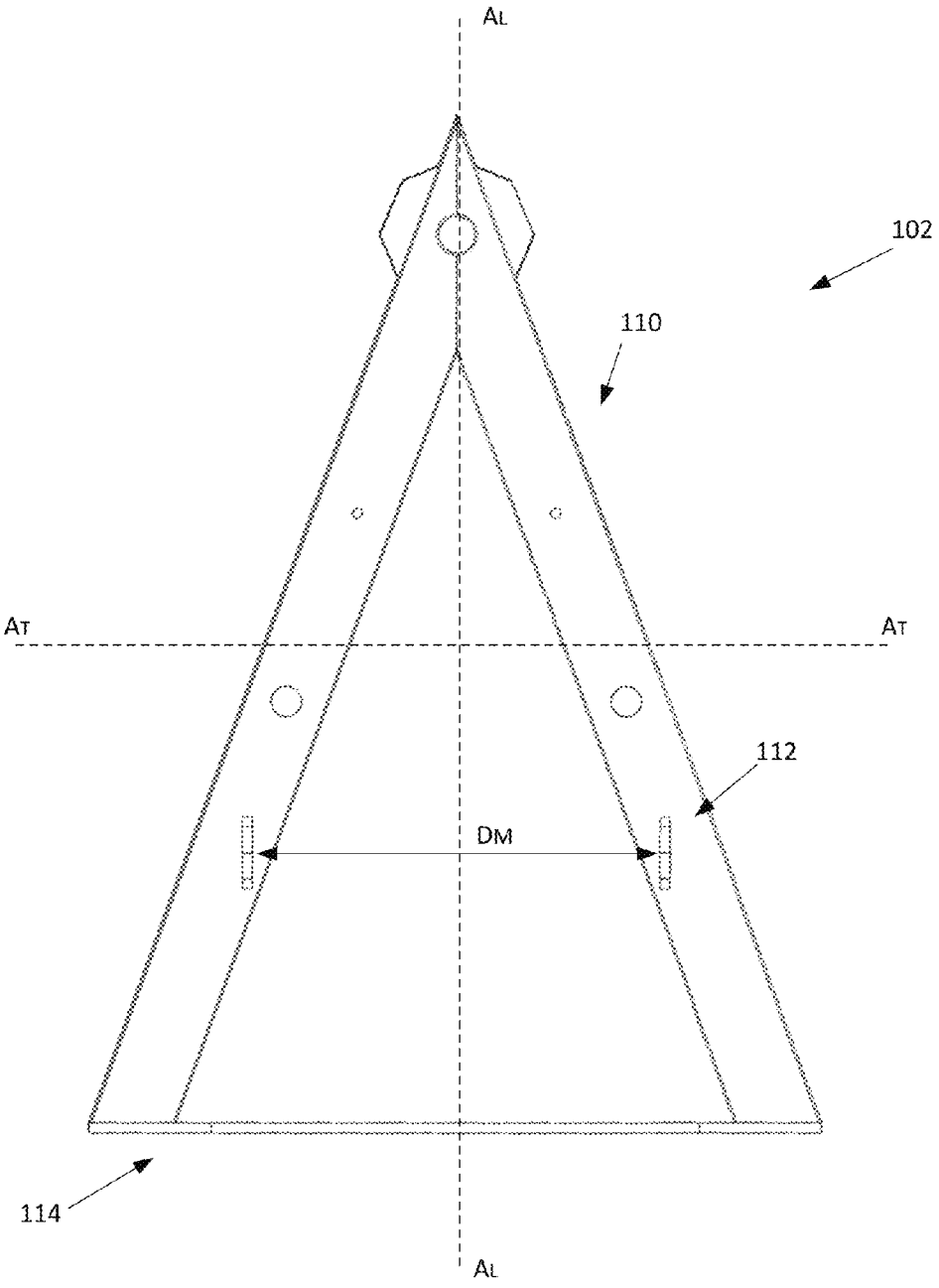
FIG. 4 is a top view of the target support system of FIG. 2.

FIG. 4 is a top view of the target support system 102 of FIG. 2, illustrating a geometry of the target support system 102. As depicted, the target support system 102 is configured to form a triangular shape which is symmetrical with respect to the longitudinal axis $A_L$. In one or more embodiments, the forward barrier 114 is arranged to function as one of three branches of the triangular shape, and the target support frame 110 operates as the remaining two branches. The target support frame 110 is also arranged symmetrically with respect to the longitudinal axis $A_L$ to ensure the stability of the target system 100 in operation. As shown in FIG. 4, the target connecting mechanism 112 is biased toward the forward end 116. In particular, the target connecting mechanism 112 is arranged between the forward end 116 and a transverse axis $A_T$ that passes through the middle line of the target support system 102 along the longitudinal axis $A_L$. This biased structure of the target connecting mechanism 112 connects the target device 104 close to the forward end 116 and put the center of mass of the target system 100 in a forward direction, thereby assisting the target system 100 in maintaining a balance thereof in operation. The center of mass biased in a forward direction reduces the tendency to twist or rotate when the target system 100 is hit by projectiles.

The target support system 102 can have various sizes to meet different demands and/or specifications for projectiles and/or firearms used with the target system 100. However, the geometry as described above remains substantially the same as the size of the target support system 102 changes. The target support system 102 can have a different width ($W_F$) of the forward barrier 114, depending on a different type of firearms. For example, when the target system 100 is used for pistol cartridges or pistol calibers, the width ($W_F$) of the forward barrier 114 is designed to be about 18 inches. When the system 100 is used for centerfire rifle cartridges, the width ($W_F$) is about 24 inches. When the system 100 is used for large calibers, the width ($W_F$) ranges between 30 and 36 inches. As the width ($W_F$) of the forward barrier 114 varies, the target support frame 110 is sized up so as to have the same ratio with respect to the forward barrier 114.

The shape of the target support system 102 also facilitates ease of storage and/or transportation of the target system 100 and/or the target support system 102. A plurality of target support systems 102 can be easily stacked in row with the forward barrier 114 facing down. When a first target support system 102 is laid on the forward barrier 114, a second target support system 102 is stacked adjacent the first target support system 102 by placing the forward barrier 114 of the second target support system 102 on the forward barrier 114 of the first target support system 102. By overlapping the forward barriers 114 of adjacent target support systems 102, multiple target support systems 102 occupy a smaller space for storage and/or transportation.

Figure 5:
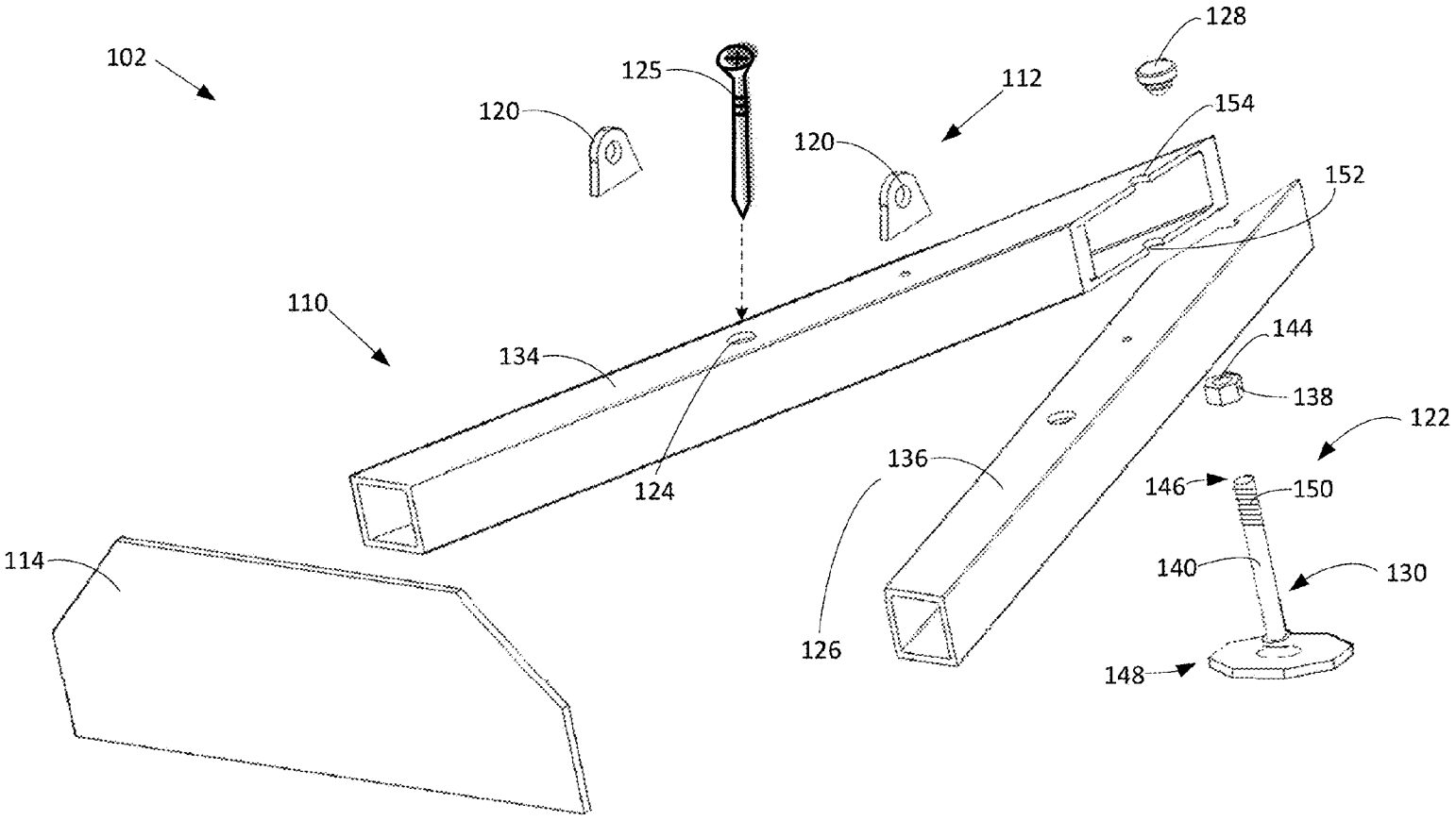
FIG. 5 is an expanded view of the target support system of FIG. 2.

FIG. 5 is an expanded view of the target support system 102 of FIG. 2, illustrating components of the target support frame 110, the leveling mechanism 122, and the damping mechanism 128.

In the depicted example, the target support frame 110 includes two leg portions 134 and 136 connected to at the rearward end 118. In one or more embodiments, the two leg portions 134 and 136 are connected by welding. In one or more embodiments, the two leg portions 134 and 136 are connected by fasteners. However, the target support frame 110 can also be integrally formed without any separate pieces.

In this example, the two leg portions 134 and 136, which are connected to each other at the rearward end 118, are connected with the forward barrier 114 at the forward end 116, thereby forming the triangular shape. In one or more embodiments, the two leg portions 134 and 136 are coupled with the forward barrier 114 by welding. In one or more embodiments, the two leg portions 134 and 136 are connected to the forward barrier 114 by fasteners.

As shown, the leveling mechanism 122 includes the level foot 130. The level foot 130 includes a nut 138, a support rod 140, and a foot plate 142.

The nut 138 is configured to connect the support rod 140 and the foot plate 142 to the target support frame 110. The nut 138 is coupled to the target support frame 110 at or adjacent the rearward end 118. In one or more embodiments, the nut 138 is attached to the target support frame 110 by welding. The nut 138 has a threaded hole 144 configured to at least partially receive the support rod 140 therein.

The support rod 140 is configured to connect the nut 138 at a top end 146 and the foot plate 142 at a bottom end 148. The support rod 140 has a threaded portion 150 at or adjacent the top end 146, which is configured to engage the threaded hole 144 of the nut 138 so that the support rod 140 is mounted to the target support frame 110. In one or more embodiments, the threaded portion 150 is formed about one third of the length of the support rod 140 from the top end 146. In one or more embodiments, the threaded portion 150 is formed on more than one third of the length of the support rod 140 to extend the range of an adjustable height of the target support frame 110.

In one or more embodiments, the target support frame 110 has a leveling hole 152 at or adjacent the rearward end 118 so that the leveling mechanism 122 adjusts the height of the target support system 102 at the rearward end 118. For example, the nut 138 is attached to the target support frame 110 such that the leveling hole 152 is aligned with the threaded hole 144. As such, when the support rod 140 is engaged with the nut 138, the threaded portion 150 of the support rod 140 can be selectively inserted into the target support frame 110 through the leveling hole 152, thereby lowering the height of the target support frame 110 at the rearward end 118.

The foot plate 142 is connected to the support rod 140 at the bottom end 148. In one or more embodiments, the foot plate 142 pivots about the support rod 140 at the bottom end 146 so as to be better adapted for an uneven target placement area.

As shown, the target damping mechanism 128 is a rubber pad that is configured to be detachably inserted into a damping hole 154 formed on the target support frame 110 at or adjacent the rearward end 118.

Figure 6:
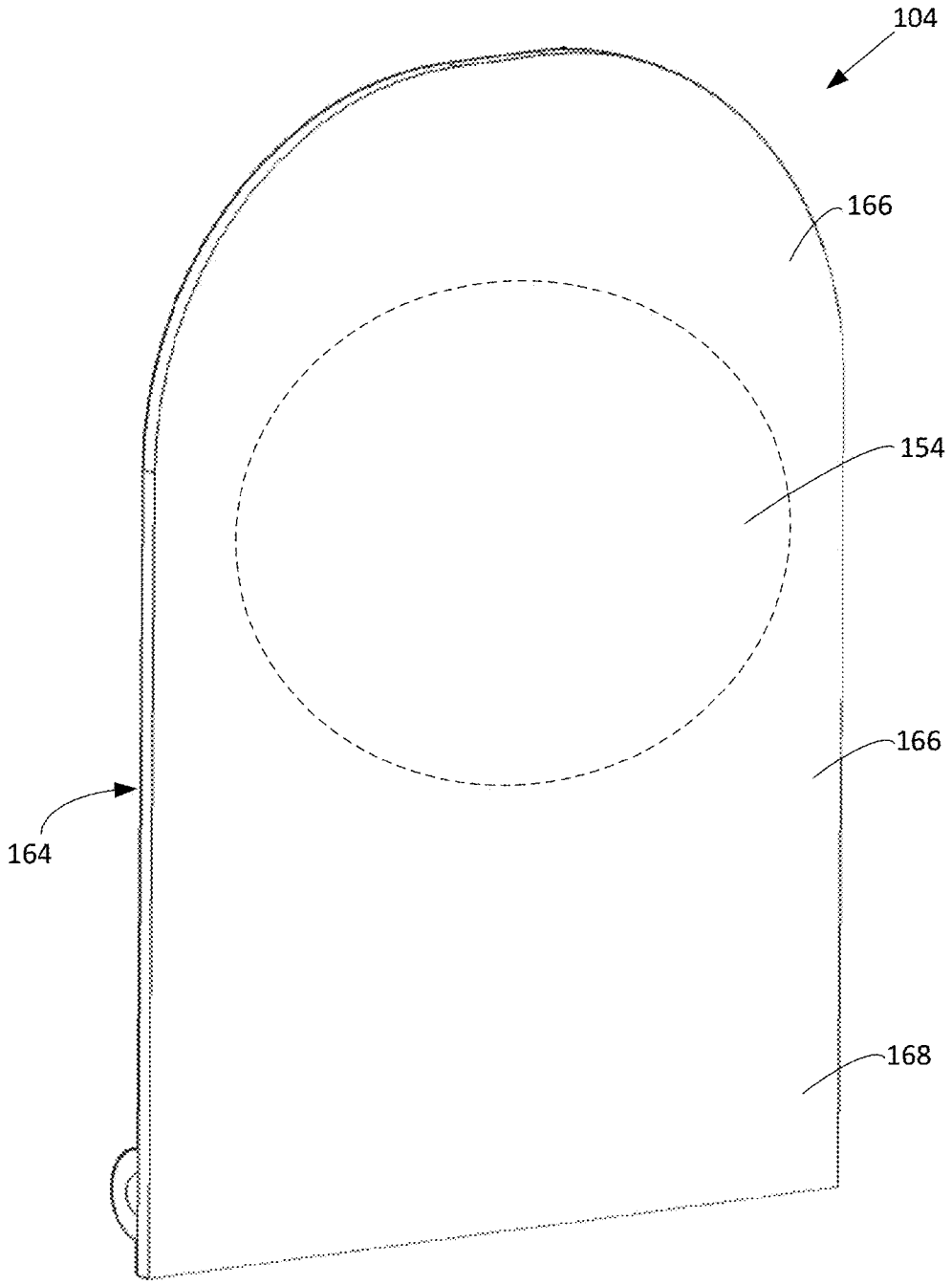
FIG. 6 is a front perspective view of a first example target device.

FIG. 6 is a front perspective view of a first example target device 104. As described above, the target device 104 is configured to be supported by the target support system 102 via the target reset mechanism 106. The target device 104 has a front face 162 and a rear face 164.

In one or more embodiments, the target device 104 is made from a metallic plate. One example of a metallic plate is an Abrasion Resistant (AR) steel plate. The metallic plate may provide abrasive resistance to the target device 104, resulting in long service life under harsh conditions. The metallic plate may also comprise a relatively lightweight material that reduces the weight of the target system 100. Further, the metallic plate may be sufficiently resistant to impact and/or sliding contact. In one or more embodiments, the target device 104 is made from AR steel, such as AR400, AR500, or AR600 steel.

In one or more embodiments, the target device 104 includes a target area portion 166 and a target engaging portion 168.

The target area portion 166 is arranged on the front face 162 of the target device 104. The target area portion 166 can be made in various shapes and/or dimensions as necessary. Examples of the target area portion 166 are further illustrated below with reference to FIGS. 8 and 9.

The target area portion 166 provides a target area 170 at which a projectile is aimed. The target area 170 is configured to provide a visually distinctive feature and guide shooters to aim their firearms or ranged weapons against the target area 170. For example, the target area 170 includes concentric circles or human-like silhouettes. A variety of shapes can be provided for the target area 170.

The target engaging portion 168 is configured to be coupled to the target support system 102 through the target reset mechanism 106. For example, the target engaging portion 168 engages the target coupling mechanism 112. In one or more embodiments, the target engaging portion 168 is arranged below the target area portion 166. The target engaging portion 168 is described in further detail with reference to FIG. 7.

Figure 7:
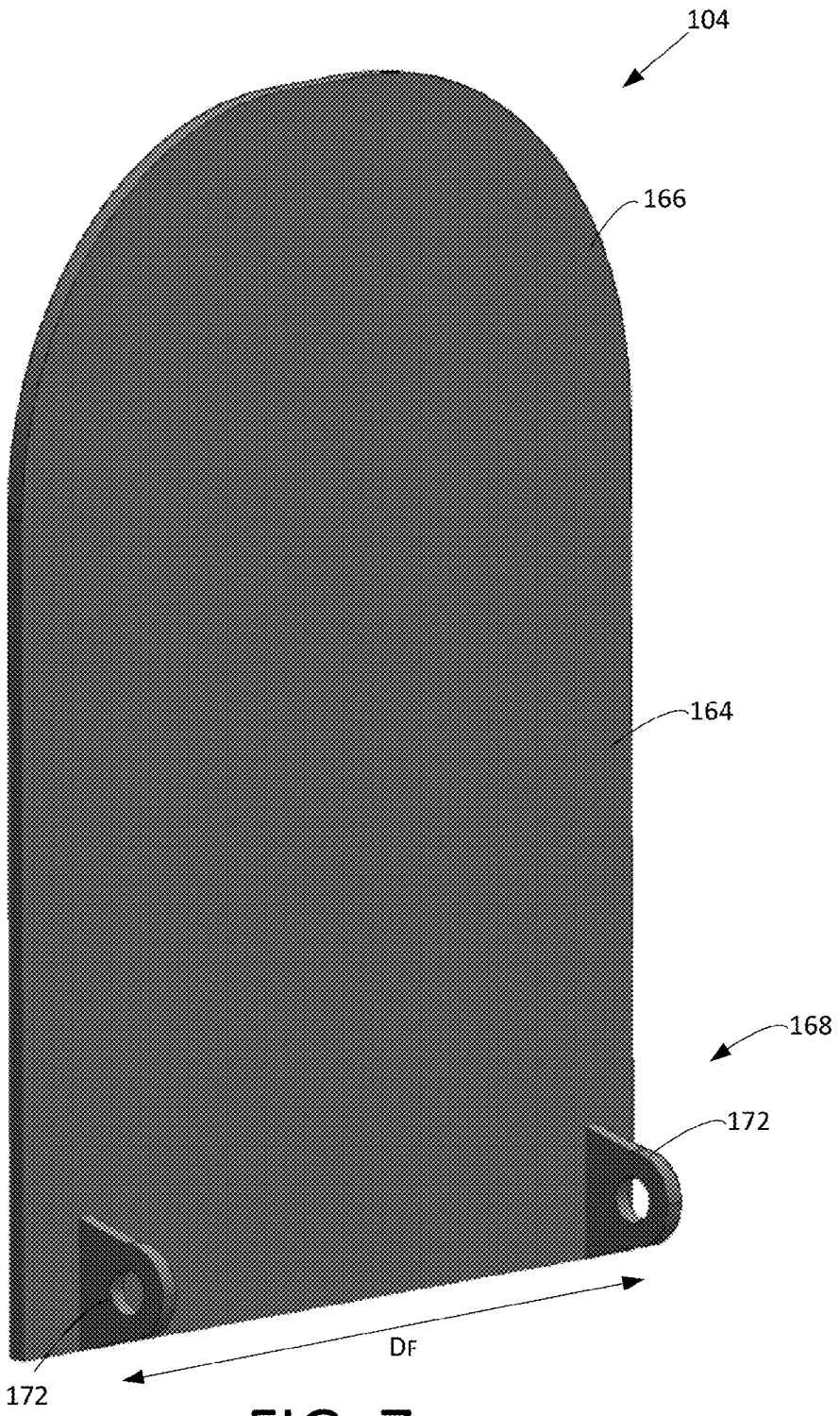
FIG. 7 is a rear perspective view of the target device of FIG. 6.

FIG. 7 is a rear perspective view of the target device 104 of FIG. 6. The target engaging portion 168 of the target device 104 includes a pair of female hinge flanges 172.

Figure 10:
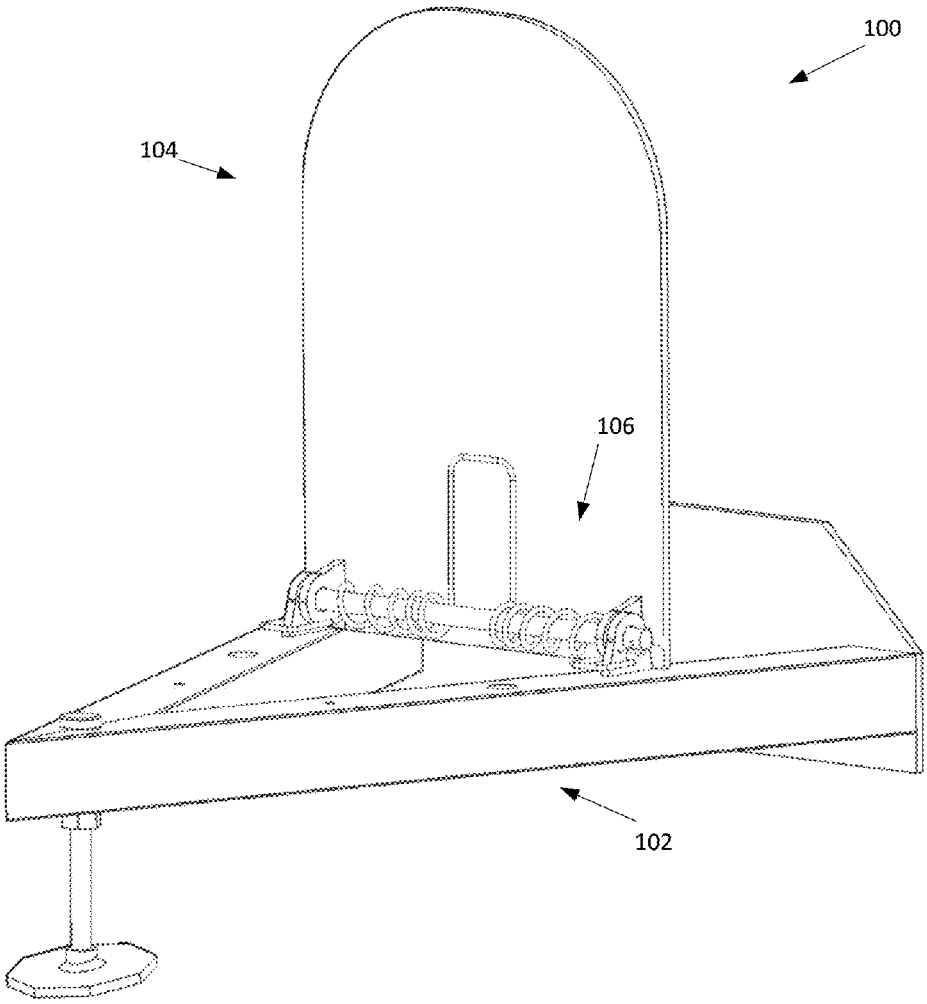
FIG. 10 is a rear perspective view of the target system of FIG. 1, illustrating an example target reset mechanism.
Figure 11:
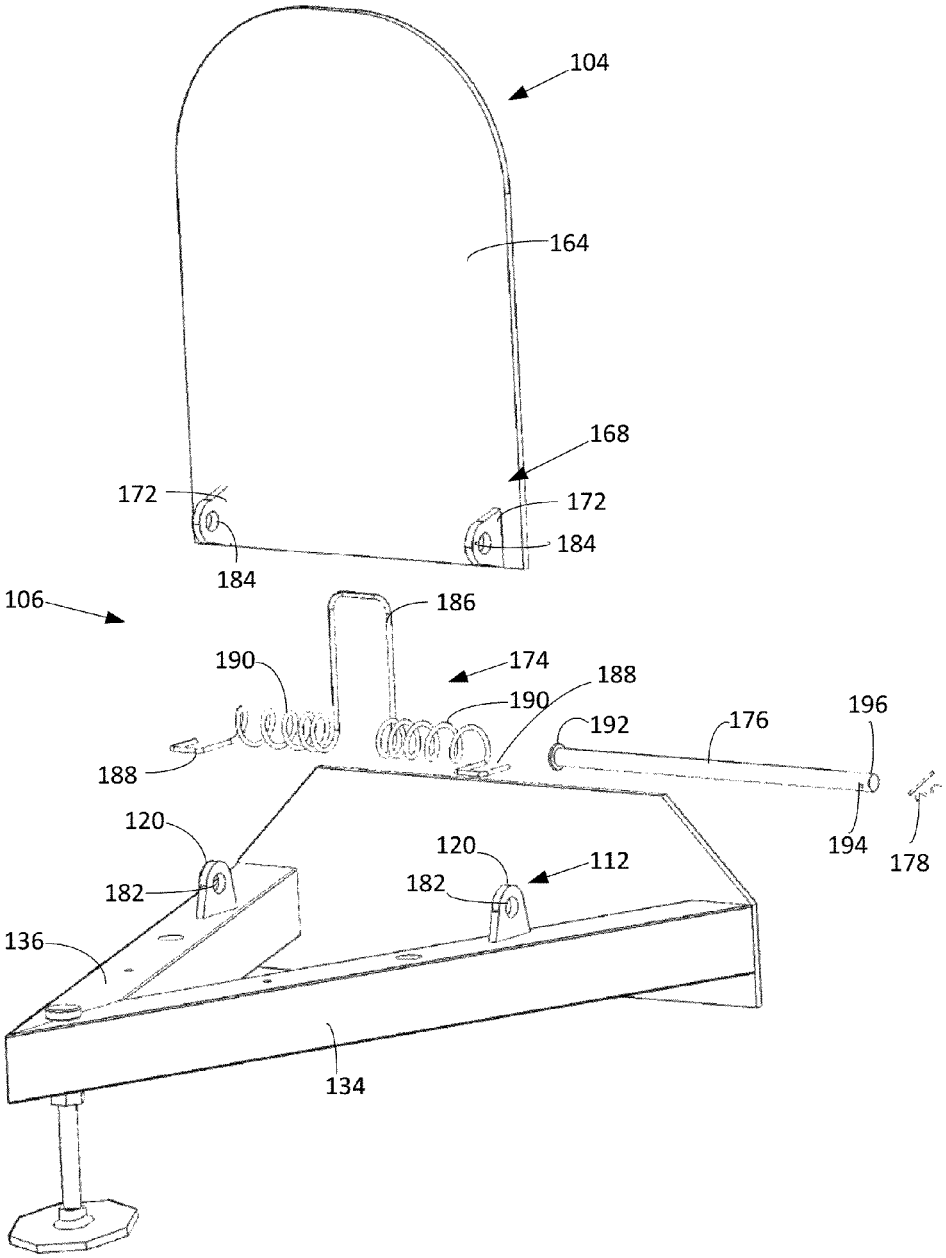
FIG. 11 is an expanded view of the target system of FIG. 10.

The pair of female hinge flanges 172 operates to engage with the pair of male hinge flanges 120 of the target coupling mechanism 112. The female hinge flanges 172 are abutted to the male hinge flanges 120, respectively, and supported by the male hinge flanges 120 by a support bar 175 (FIG. 11). In one or more embodiments, the female hinge flanges 172 are spaced apart at a distance $D_F$, which is configured to be smaller than the distance $D_M$ of the male hinge flange 120 of the target coupling mechanism 112 so that the female hinge flanges 172 are contained between the male hinge flanges 120, as depicted in FIG. 10.

Figure 8:
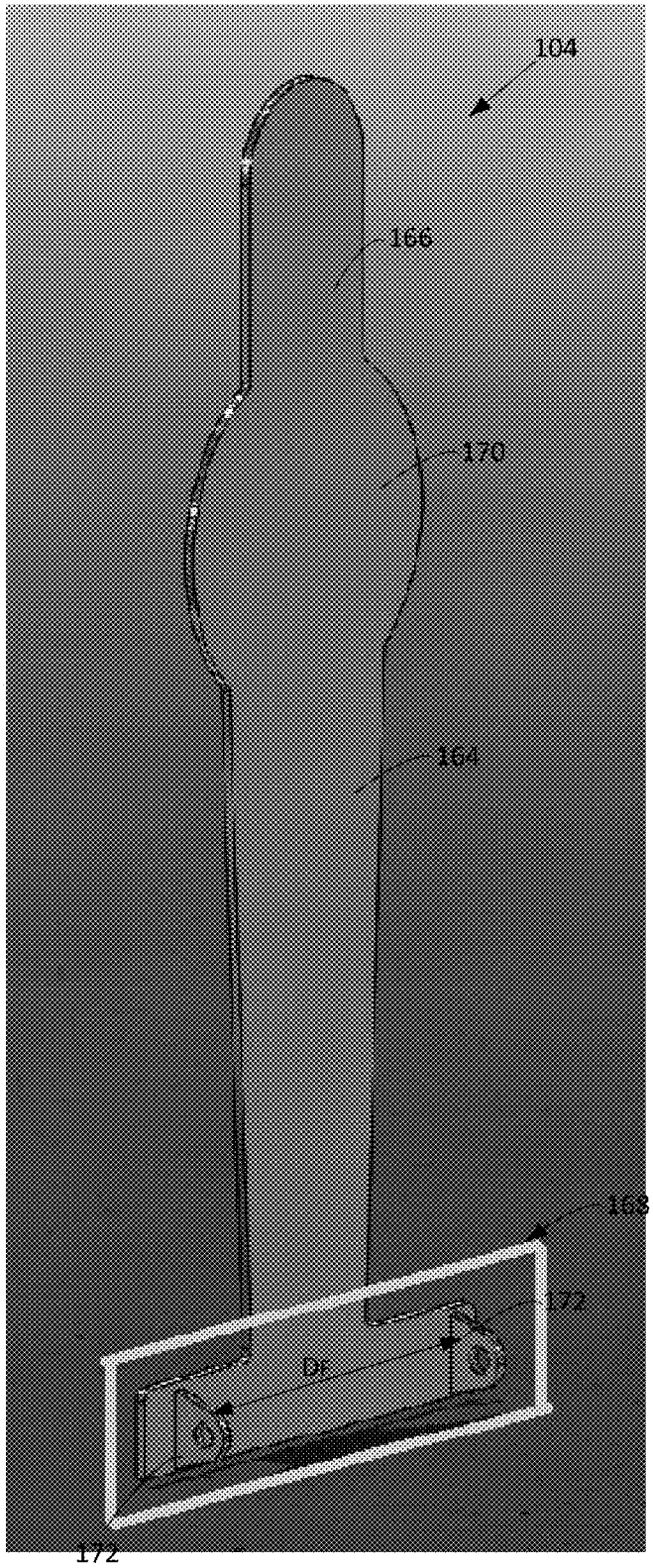
FIG. 8 is a rear perspective view of a second example target device.

FIG. 8 is a rear perspective view of a second example target device 104. Similar to the target device 104 in the first example, the target device 104 includes the target area portion 166 and the target engaging portion 168.

The target area portion 166 has a different shape and dimension from the first example target area portion 166. In this example, the target area portion 166 is shaped to have a long height in a vertical direction with a narrow width in a horizontal direction. In one or more embodiments, the target area portion 166 has substantially a circular target area 170 formed in the middle of the target area portion 166.

The target engaging portion 168 is configured to be substantially similar to, or the same as, the target engaging portion 168 of the first example. In particular, the target engaging portion 168 has the pair of female hinge flanges 172 spaced apart each other at the same distance $D_F$. By making the target engaging portion 168 the same as the one in the first example, the target device 104 can be replaceably coupled to the target support system 102 regardless of the shape or dimension of the target area portion 166.

Figure 9:
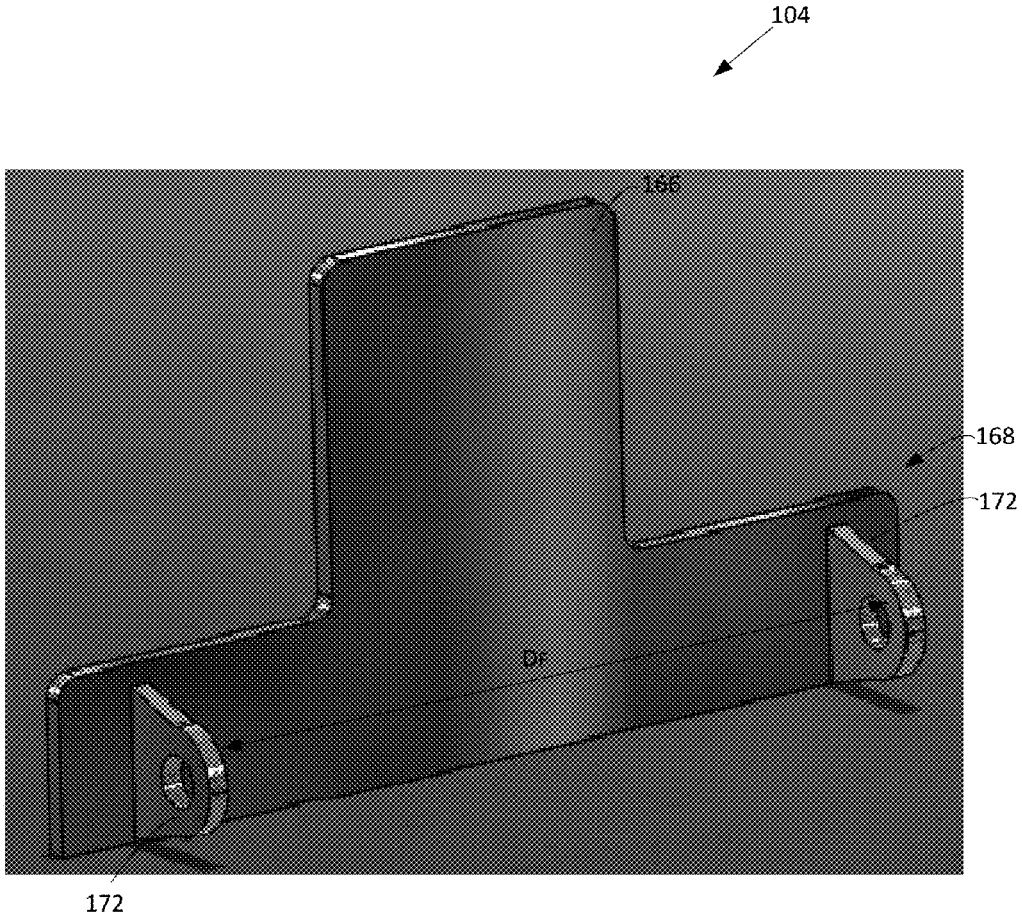
FIG. 9 is a rear perspective view of a third example target device.

FIG. 9 is a rear perspective view of a third example target device 104. Similar to the target device 104 in the first or second example, the target device 104 includes the target area portion 166 and the target engaging portion 168.

In the third example, the target area portion 166 has a different shape and/or dimension from the first or second example target area portion 166. For example, the target area portion 166 has a shorter height in a vertical direction than the one in the second example.

However, the target engaging portion 168 has substantially similar to, or the same as, the target engaging portion 168 of the first or second example. The target engaging portion 168 has the pair of female hinge flanges 172 spaced part each other at the same distance $D_F$, which is configured to be abutted to the male hinge flange 120 of the target coupling mechanism 112.

As shown above, the target area portion 166 can have various shapes and/or dimensions while the target engaging portion 168 maintains the same or similar structure. As such, the target device 104 can be customized to provide different target area portions 166 and/or target areas 170, but still can be mounted on the same target support system 102.

FIG. 10 is a rear perspective view of the target system 100 of FIG. 1, illustrating an example of the target reset mechanism 106. The target reset mechanism 106 is configured to pivotally couple the target device 104 to the target support system 102. In one or more embodiments, the target reset mechanism 106 allows the target device 106 to be reactive when hit by a projectile. For example, the target reset mechanism 106 operates the target device 104 between the raised position, in which the target device 104 is arranged to be substantially vertical as depicted in FIG. 10, and the lowered position, in which the target device 10 is arranged substantially horizontal with respect to the target support system 102. In the lower position, the target device 10 is lowered behind the forward barrier 114 and hidden from the forward direction. The target reset mechanism 106 is described in further detail with reference to FIG. 11.

FIG. 11 is an expanded view of the target system 100 of FIG. 10, illustrating components of the target reset mechanism 106. In one or more embodiments, the target reset mechanism 106 includes the target coupling mechanism 112, the target engaging portion 168, a support spring device 174, a support bar 176 and a locking pin 178.

As described above, in some embodiments, the target coupling mechanism 112 includes the pair of male hinge flanges 120 extending from the target support system 102. The male hinge flanges 120 are configured to pivotally support the target device 104 on the target support system 102. In one or more embodiments, the male hinge flanges 120 are arranged on the two leg portions 134 and 136 of the target support frame 110, respectively, and are positioned symmetrically about the longitudinal axis $A_L$ to provide stability of the target device 104 with respect to the target support system 102. Each of the male hinge flanges 120 has a male through-hole 182 to engage the support bar 176 therethrough.

As described above, in some embodiments, the target engaging portion 168 of the target device 104 includes the pair of female hinge flanges 172 extending therefrom. The female hinge flanges 172 are configured to engage with the male hinge flanges 120, respectively, to pivotally support the target device 104 against the target support system 102. Each of the female hinge flanges 172 has a female through-hole 184 that is configured to be aligned to the male through-hole 182 when the target device 104 is coupled to the target support system 102.

The support spring device 174 operates to support the target device 104 against the target support system 102 and bias the target device 104 in the raised position. In one or more embodiments, the support spring device 174 is of a tension spring. In one or more embodiments, the support spring device 174 is of a helical torsion spring type. The support spring device 174 can have different specifications and/or properties, such as torsion coefficient or torsion constant, according to different shapes, weights and/or dimensions of the target device 104.

In one or more embodiments, the support spring device 174 has a first end 186 and a second end 188. The first end 186 engages the rear face 164 of the target device 104 while the second end 188 engages the target support frame 110. By way of example, the first end 186 is abutted to a middle portion of the target engaging portion 168 between the female hinge flanges 172, and the second end 188 is arranged to surround the male hinge flanges 172 on the target support frame 110. The first end 186 and the second end 188 are connected by a helical torsion spring 190, which exerts tension on the first and second ends 186 and 188 in opposite directions so that the first end 186 remains apart against the second end 188.

The support bar 176 is configured to engage the female hinge flanges 172 and the support spring device 174 with the male hinge flanges 120. The support bar 176 has a head end 192 and a tail end 194. In one or more embodiments, the tail end 194 of the support bar 174 passes through the male through-holes 182, the female through-holes 184, and the helical torsion spring 190, so that the female hinge flanges 120 and the support spring device 174 are coupled to the male hinge flanges 172. Because of the torsion of the support spring device 174, the target device 104 is in the raised position when the support bar 176 is inserted to assemble the female hinge flanges 172 and the support spring device 174 with the male hinge flanges 120. In one or more embodiments, the head end 192 is sized to be bigger than the male and female through-holes 182 and 184 so that the support bar 176 is not disengaged at the head end 192 of the support bar 176.

The locking pin 178 is configured to hold the support bar 176 at the tail end 194 in place. In one or more embodiments, the support bar 176 has a pin hole 196 at the tail end 194, which is configured to receive the locking pin 178. Once the support bar 176 is engaged with the male hinge flanges 120, the female hinge flanges 172, and the support spring device 174, the tail end 194 of the support bar 176 extrudes from the male and female hinge flanges 120 and 172 and is exposed to receive the locking pin 178. By engaging the locking pin 178 at the tail end 194 of the support bar 176, the support bar 176 is prevented from being disengaged from the target reset mechanism 106 at the tail end 194 of the support bar 176. In one or more embodiments, the locking pin 178 is of a cotter pin type. Examples of such a cotter pin include Rue Ring™.

Figure 12:
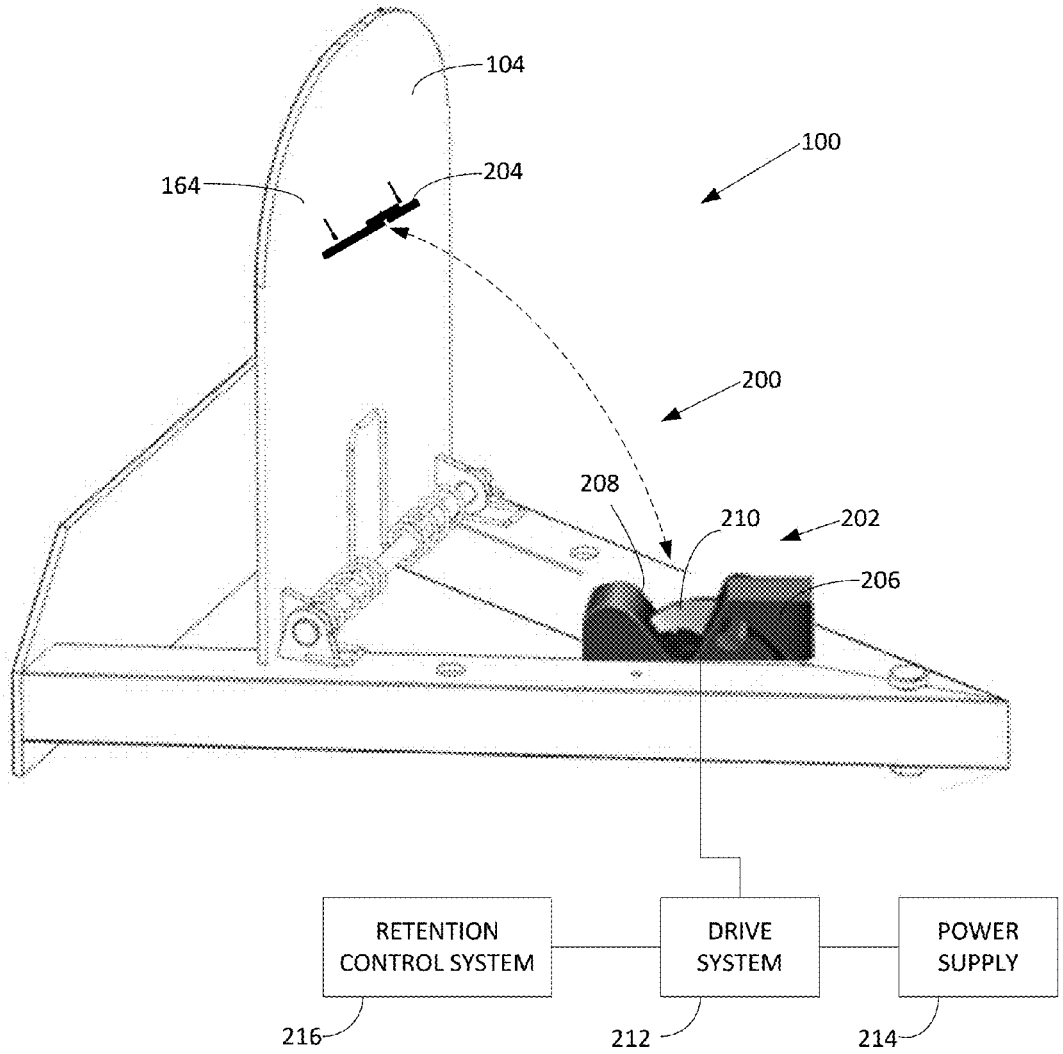
FIG. 12 is a schematic view of an example target retention mechanism.

FIG. 12 is a schematic view of an example target retention mechanism 200. The target retention mechanism 200 operates to selectively retain the target device 104 with respect to the target support system 102 between the raised position and the lowered position. In one or more embodiments, the target retention mechanism 200 includes a latching device 202 and an engaging bar 204. In one or more embodiments, the target retention mechanism 200 further includes a drive system 212, a power supply 214, and a retention control system 126.

The latching device 202 operates to either retain the target device 104 in the lowered position, or release the target device 104 therefrom allowing the target device 104 to move to the raised position by the target reset mechanism 106. In one or more embodiments, the latching device 202 is arranged between the two leg portions 134 and 136 of the target support frame 110.

In one or more embodiments, the latching device 202 includes a body 206, a latch channel 208, and a latch finger 210.

The body 206 is configured to accommodate the latch finger 210 therein. In one or more embodiments, the body 206 is connected to the target support system 102 through the accessory attachment mechanism 126.

The latch channel 208 is formed on the body 206 and configured to receive the engaging bar 204. In one or more embodiments, the latch channel 208 is formed as a V-shape.

The latch finger 210 is mounted within the body 206 and operates between an open position and a closed position. In the open position, the latch finger 210 is retracted into the body 206 and opens the latch channel 208 so that the engaging bar 204 is released from the latch channel 208. In the closed position, the latch finger 210 extends over the latch channel 208 so that the engaging bar 204 is restricted within the latch channel 208 by the latch finger 210.

The engaging bar 204 is attached to the target device 104 and configured to be engaged with the latching device 202. For example, the engaging bar 204 is arranged on the rear face 164 of the target device 104 in a manner that, when the target device 104 is in the lowered position, the engaging bar 204 is inserted into the latch channel 208.

In one or more embodiments, the latch finger 201 is spring-operated and biased in the closed position as default. Then, the latch finger 210 can be configured to be retracted into the body 206 to be in the open position when the engaging bar 204 is inserted above the latch finger 210 into the latch channel 208. Once, the engaging bar 204 is engaged within the latch channel 208, the latch finger 210 is automatically switched back to the closed position because of the return force exerted on the latch finger 201 that biases the latch finger 201 in the closed position.

The drive system 212 is configured to operate the latching device 202. In one or more embodiments, the drive system 212 drives the latch finger 210 between the open position and the closed position. The drive system 212 can be of any type suitable for switching the latch finger 210 between the open and closed position. For example, the drive system 212 is a mechanical actuator. One example of such a mechanical actuator is a solenoid.

The power supply 214 operates to provide power to the drive system 212. In one or more embodiments where the drive system 212 is configured as a solenoid, the power supply 214 can be a solar panel because the solenoid is operated with only a small amount of power. In this case, the power supply 214 does not need an independent power source (such as a battery) or other electrical and mechanical components, which require large power consumption and make the target system heavy, less portable and expansive. By using a solenoid as the drive system 212 and a solar panel as the power supply 214, the target retention mechanism 200 can be made smaller in size and more power-efficient than other automated target systems.

The retention control system 216 is configured to control the drive system 212. In one or more embodiments, the retention control system 216 selectively operates the drive system 212 to switch the latch finger 210 from the closed position to the open position. As described below, the retention control system 216 can be operated by a shooter or user.

Figure 13:
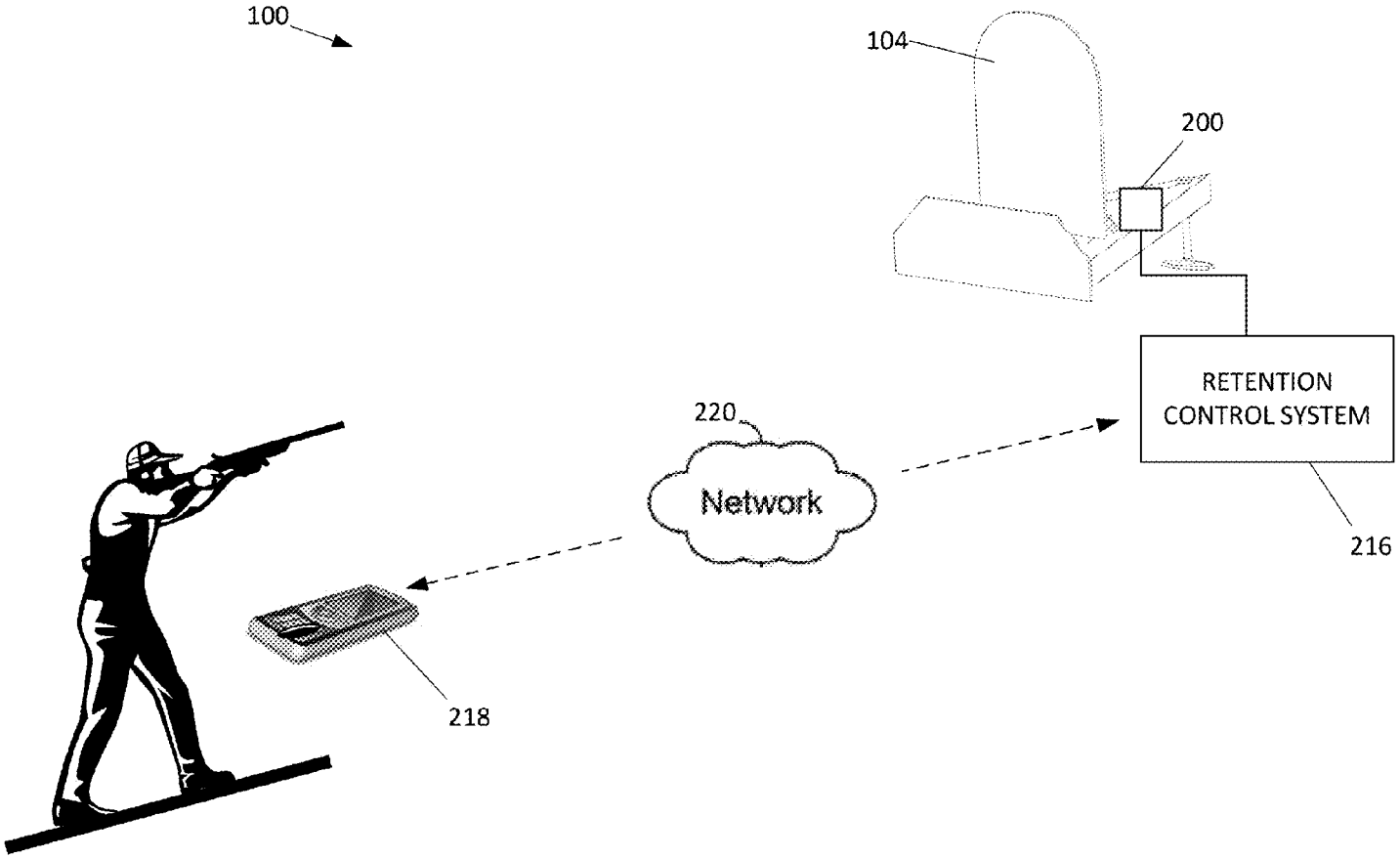
FIG. 13 illustrates an example operation of the target system of FIG. 1 with an example target control device.

FIG. 13 illustrates an example operation of the target system 100 of FIG. 1. In one or more embodiments, a shooter or user uses a target control device 218 to control the target device 104 between the raised position and the lowered position.

In one or more embodiments, the target control device 218 is configured to control the retention control system 216. For example, when a shooter hit the target device 104 with a projectile, the target device 104 moves from the raised position to the lowered position. As described above, the target retention mechanism 200 then operates to retain the target device 104 in the lowered position by engaging the engaging bar 204 within the latching device 202. Thus, the target device 104 remains in the lowered position unless the target device 104 is released from the latching device 202. The shooter can manipulate the target control device 218 to control the retention control system 216 so that the retention control system 216 operates the drive system 212 to switch the latch finger 210 from the closed position to the open position, thereby releasing the target device 104 from the latching device 202.

In one or more embodiments, the target control device 218 is connected to the retention control system 216 in an electronic communication network 220. The communication network 220 facilitates communication between the target control device 218 and the retention control system 216. An electronic communication network is a set of computing devices and links between the computing devices. The computing devices in the network use the links to enable communication among the computing devices in the network. The network 220 can include routers, switches, mobile access points, bridges, hubs, intrusion detection devices, storage devices, standalone server devices, blade server devices, sensors, desktop computers, firewall devices, laptop computers, handheld computers, mobile telephones, and other types of computing devices. In various embodiments, the network 220 includes various types of links. For example, the network 108 includes wired and/or wireless links. Furthermore, in various embodiments, the network 108 is implemented at various scales. For example, the network 220 can be implemented as one or more local area networks (LANs), metropolitan area networks, subnets, wide area networks (such as the Internet), or can be implemented at another scale.

Figure 14:
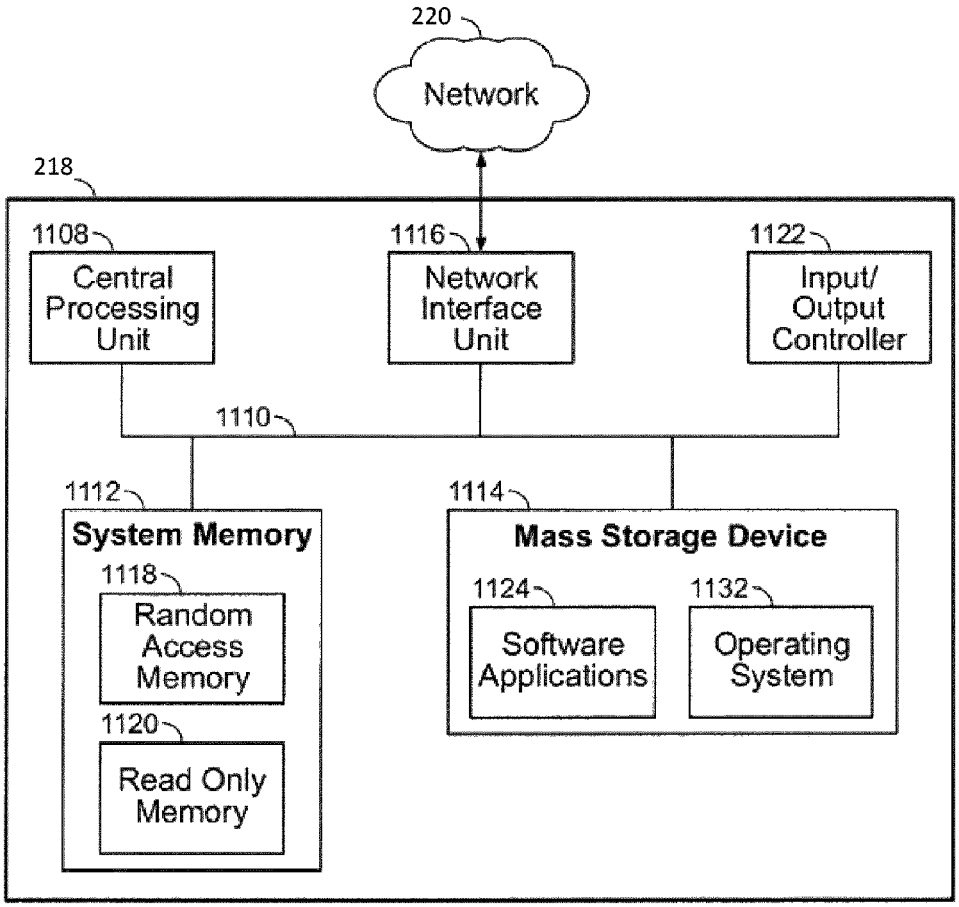
FIG. 14 illustrates example physical components of the target control device of FIG. 13.

FIG. 14 illustrates example physical components of the target control device 218 of FIG. 13. In one or more embodiments, the target control device 218 include at least one central processing unit ("CPU") 1108, a system memory 1112, and a system bus 1110 that couples the system memory 1112 to the CPU 1108. The system memory 1112 includes a random access memory ("RAM") 1118 and a read-only memory ("ROM") 1120. A basic input/output system containing the basic routines that help to transfer information between elements within the target control device 218, such as during startup, is stored in the ROM 1120. The target control device 218 further includes a mass storage device 1114. The mass storage device 1114 is able to store software instructions and data.

The mass storage device 1114 is connected to the CPU 1108 through a mass storage controller (not shown) connected to the bus 1110. The mass storage device 1114 and its associated computer-readable data storage media provide non-volatile, non-transitory storage for the target control device 218. Although the description of computer-readable data storage media contained herein refers to a mass storage device, such as a hard disk or CD-ROM drive, it should be appreciated by those skilled in the art that computer-readable data storage media can be any available non-transitory, physical device or article of manufacture from which the target control device 218 can read data and/or instructions.

Computer-readable data storage media include volatile and non-volatile, removable and non-removable media implemented in any method or technology for storage of information such as computer-readable software instructions, data structures, program modules or other data. Suitable types of computer-readable data storage media include, but are not limited to, RAM, ROM, EPROM, EEPROM, flash memory or other solid state memory technology, CD-ROMs, digital versatile discs ("DVDs"), other optical storage media, magnetic cassettes, magnetic tape, magnetic disk storage or other magnetic storage devices, or any other medium which can be used to store the desired information and which can be accessed by the target control device 218.

According to various embodiments of the invention, the target control device 218 may operate in a networked environment using logical connections to remote network devices through the network 108, such as a local network, the Internet, or another type of network. The target control device 218 connects to the network 108 through a network interface unit 1116 connected to the bus 1110. It should be appreciated that the network interface unit 1116 may also be utilized to connect to other types of networks and remote computing systems. The target control device 218 also includes an input/output controller 1122 for receiving and processing input from a number of other devices, including a keyboard, a mouse, a touch user interface display screen, or another type of input device. Similarly, the input/output controller 1122 may provide output to a touch user interface display screen, a printer, or other type of output device.

As mentioned briefly above, the mass storage device 1114 and the RAM 1118 of the target control device 218 can store software instructions and data. The software instructions include an operating system 1132 suitable for controlling the operation of the target control device 218. The mass storage device 1114 and/or the RAM 1118 also store software instructions, that when executed by the CPU 1108, cause the target control device 218 to provide the functionality of the target control device 218 discussed in this document. For example, the mass storage device 1114 and/or the RAM 1118 can store software instructions that, when executed by the CPU 1108, cause the PMP device to display the workflow screen 300 and other screens.

It should be appreciated that various embodiments can be implemented (1) as a sequence of computer implemented acts or program modules running on a computing system and/or (2) as interconnected machine logic circuits or circuit modules within the computing system. The implementation is a matter of choice dependent on the performance requirements of the computing system implementing the invention. Accordingly, logical operations including related algorithms can be referred to variously as operations, structural devices, acts or modules. It will be recognized by one skilled in the art that these operations, structural devices, acts and modules may be implemented in software, firmware, special purpose digital logic, and any combination thereof without deviating from the spirit and scope of the present invention as recited within the claims set forth herein.

Figure 15:
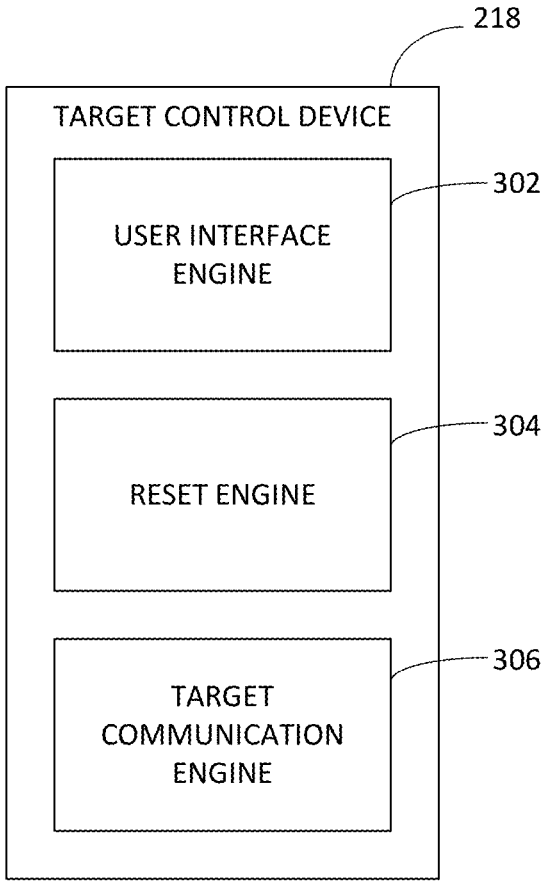
FIG. 15 illustrates example functional operations of the target control device of FIG. 13.

FIG. 15 illustrates example functional operations of the target control device 218 of FIG. 13. In one or more embodiments, the target control device 218 includes a user interface engine 302, a reset engine 304, and a target communication engine 306.

The user interface engine 302 is configured to receive a user's instructions on operation of the target system 100 and display the status and/or configuration of the target system 100. In one or more embodiments, the user interface engine 302 provides user graphic interface on a screen 222 of the target control device 218, which allows a user to interact with the device 218. The user interface engine 302 also operates to detect inputs from the device 218.

The reset engine 304 is configured to receive the user's instruction from the user interface engine 302 and generate a signal for controlling the retention control system 216. For example, when the user interface engine 302 detects the user's instruction or request for switching the target device 104 to the raised position, the reset engine 304 receives the instruction from the user interface engine 302 and produces a signal for requesting the retention control system 216 to switch the latch finger 210 from the closed position to the open position so that the target device 104 is released from the latching device 202.

The target communication engine 306 operates to transmit the signal generated at the reset engine 304 to the retention control system 216, and receive a signal from the retention control system 216, which indicates the status of the target system 100, such as whether the target device 104 is hit by a projectile, whether the target device 104 is in the lowered position, or whether the target device 104 is in the raised position and ready for shooting.

Figure 16:
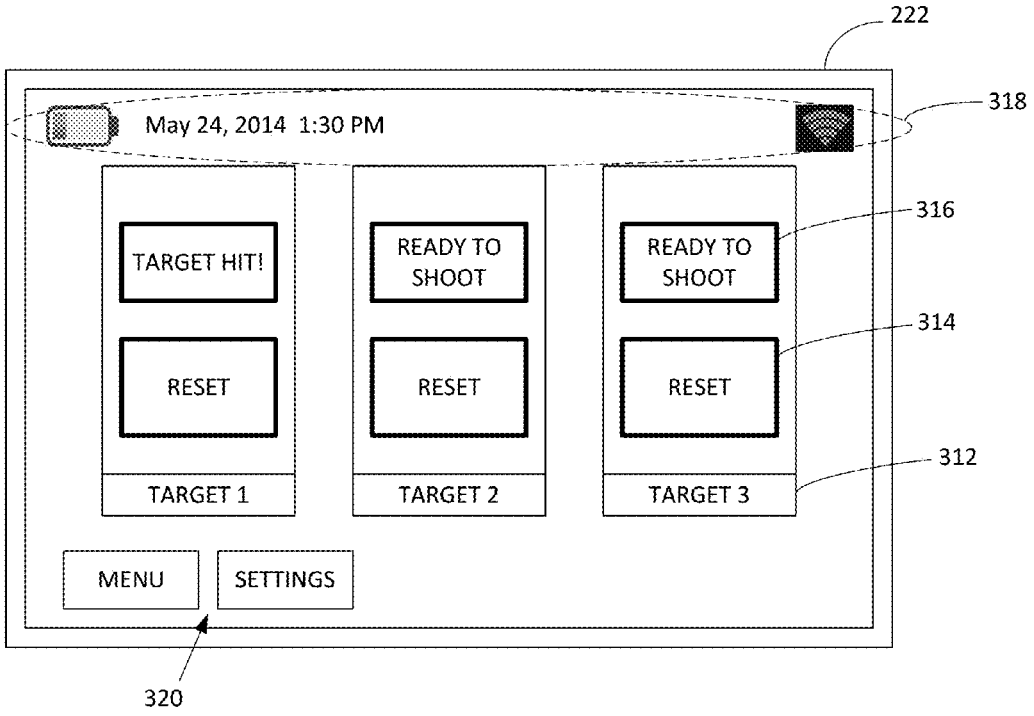
FIG. 16 is an example screen shot of a display screen of the target control device of FIG. 13.

FIG. 16 is an example screen shot of a display screen 222 of the target control device 218. In one or more embodiments, the display screen 222 shows a target ID frame 312, a reset button 314, a target status bar 316, a device status bar 318, and navigation taps 320.

The target ID frame 312 is configured to identify and display a particular target system 100 on the screen 222. In one or more embodiments, the target control device 218 is configured to control a plurality of target systems 100, and thus the target control device 218 needs to display all target systems 100 that are controlled by the device 218. In the depicted example, the target control device 218 is associated with three target systems 100. In such cases, the target ID frame 312 indicates which target system 100 is associated with the reset button 314 and the target status bar 316.

The reset button 314 provides an interface on which a user taps to input a request to reset the target system 100. The reset button 314 is incorporated within the corresponding target ID frame 312.

The target status bar 316 provides information on the status of the corresponding target system 100. Such information includes, but is not limited to, whether the target device 104 is hit by a projectile, or whether the target device 104 is in the raised position and the target system 100 is ready for shooting. The target status bar 316 is incorporated with the corresponding target ID frame 312.

The device status bar 318 is configured to provide information on the target control device 218, such as but not limited to, a batter status indicator, time and date, and a network connectivity status indicator.

The navigation tabs 320 provide various options that a user can select or change for the target control device 218. Examples of the navigation tabs 320 include a menu button and a settings button for the target control device 218.

Figure 17:
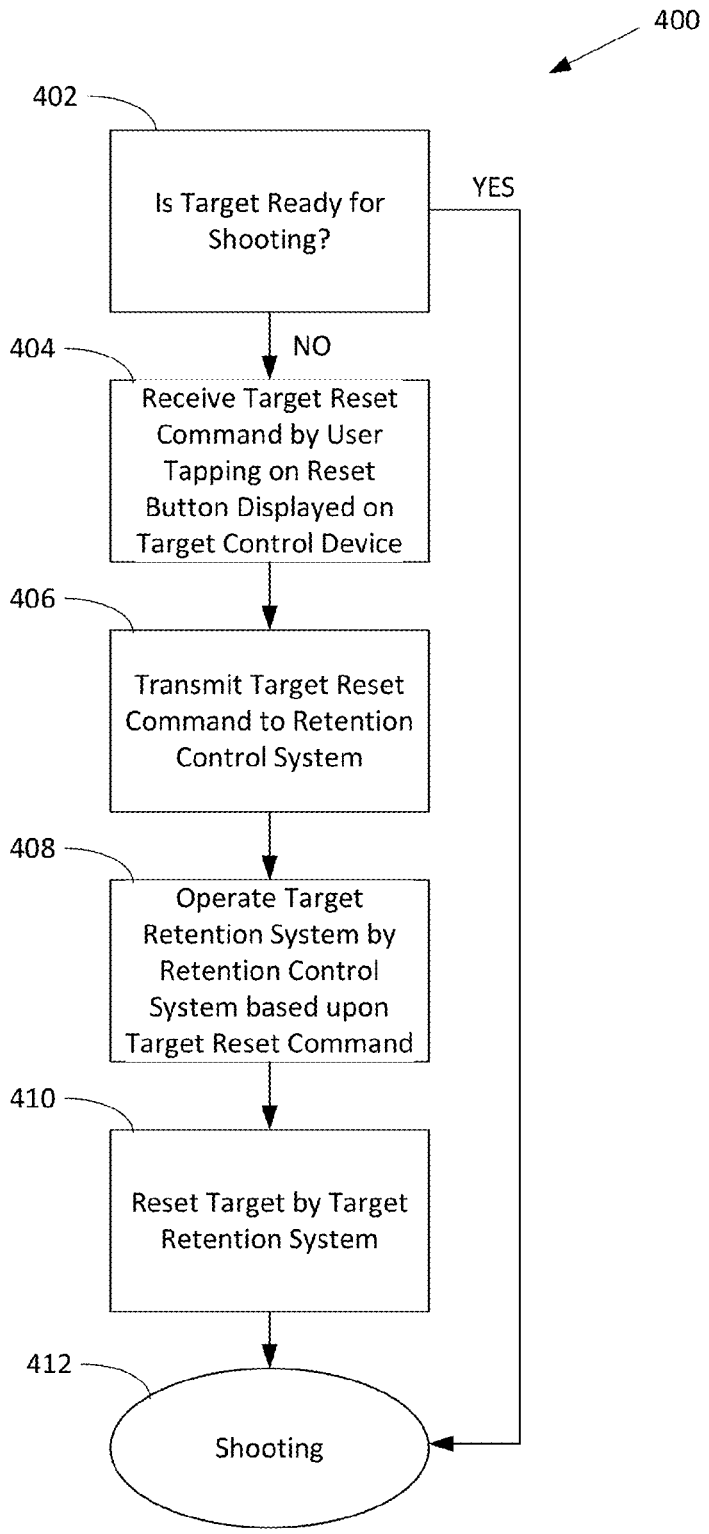
FIG. 17 is a flowchart illustrating an example method of controlling the target system of FIG. 1.

FIG. 17 is a flowchart illustrating an example method 400 of controlling the target system 100 of FIG. 1.

In one or more embodiments, the method 400 generally begins with operation 402. At the operation 402, it is determined whether the target system 100 is ready for shooting. The target system 100 is ready for shooting when the target device 104 is in the raised position. In one or more embodiments, the target control device 218 displays on the screen 222 that a particular target system 100 is ready for shooting, and a user can recognize from the target control device 218 that the particular target system 100 is ready for shooting. If it is determined that the target system 100 is ready for shooting ("YES" at the operation 402), then the user can shoot a projectile toward the target system 100 (operation 412). If it is determined that the target system 100 is not ready for shooting ("NO" at the operation 402), the method 400 proceeds to operation 404.

In one or more embodiments, at the operation 404, the target control device 218 receives a target reset command from the user. In one or more embodiments, the user inputs the command by tapping on the reset button 314 displayed on the screen 222 of the target control device 218. Then, the method 400 proceeds to operation 406.

In one or more embodiments, at the operation 406, the target control device 218 transmits the target reset command to the retention control system 216 through the network 220. Then, the method 400 proceeds to operation 408.

In one or more embodiments, at the operation 408, the retention control system 216 operates the target retention mechanism 216 based upon the target reset command so that the latching device 202 releases the target device 104.

Subsequently, at the operation 410, the target retention mechanism 216 controls the drive system 212 so that the drive system 212 operates the target device 104 to switch from the lowered position to the raised position. Then, the target system 100 is ready for shooting at the operation 412.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A target support system comprising:

a target support frame configured to be placed onto a target placement area;

a target connecting mechanism arranged on the target support frame, the target connecting mechanism including a pair of target connecting flanges;

a target device being operatively supported by the target connecting mechanism, the target device having a front face and a rear face, the rear face including at least a pair of target device flanges mounted thereto;

a support bar configured to engage the target connecting flanges and the target device flanges to hingedly connect the target device with the support frame;

a support spring device encircling the support bar, the support spring device having a first end and a second end, the first end of the support spring device engaging the target device, the second end of the support spring device engaging the target support frame;

a latching device for selectively latching the target device, the latching device having an open position and a closed position and comprising an electrical drive system configured to switch the latching device between the open and closed positions; and a forward barrier protecting the system from impact of a projectile on the system.

2. The system of claim 1, further comprising a target reset mechanism operating the target device between a raised position and a lowered position, wherein the target device is raised to a substantially vertical position with respect to the target support system in the raised position, and wherein the target device is lowered to a substantially horizontal position with respect to the target support system in the lowered position.

3. The system of claim 1, wherein the system has forward and rearward ends, the forward end facing against the projectile when the system is placed for shooting, and the rearward end opposite to the front end, and wherein the forward barrier includes a protection plate arranged at the forward end of the system.

4. The system of claim 3, wherein the protection plate is dimensioned to at least partially cover the target connecting mechanism from the projectile toward the system.

5. The system of claim 3, wherein the protection plate is made from an AR steel.

6. The system of claim 1, wherein the system has forward and rearward ends, the forward end facing against the projectile when the system is placed for shooting, and the rearward end opposite to the front end, and wherein the target supporting frame includes two leg portions connected at the rearward end and connected to the forward barrier so as to form a triangular shape.

7. The system of claim 1, wherein the target connecting mechanism is pivotable between a raised position and a lowered position, wherein the target device is raised to a substantially vertical position with respect to the target support system in the raised position, and wherein the target device is lowered to a substantially horizontal position with respect to the target support system in the lowered position.

8. The system of claim 1, further comprising a leveling mechanism configured to support the target support frame against the target placement area and stabilize the target support system on the target placement area.

9. The system of claim 8, wherein the leveling mechanism includes a level foot connected to the target support frame.

10. The system of claim 1, further comprising a target damping mechanism configured to reduce collision impact and vibration caused by the target device that moves from a raised position to a lowered position after impact by the projectile, wherein the target device is raised to a substantially vertical position with respect to the target support system in the raised position, and wherein the target device is lowered to a substantially horizontal position with respect to the target support system in the lowered position.

11. A target system comprising:

a target support system including:

a target support frame configured to be placed onto a target placement area;

a target connecting mechanism arranged on the target support frame, the target connecting mechanism including a pair of target area connecting flanges; and a forward barrier protecting the system from impact of a projectile on the system, a target device including:

a target area portion providing a target area at which a projectile is aimed, the target area being operatively supported by the target connecting mechanism, the target area having a front face and a rear face; and a target engaging portion configured to be coupled to the target support frame, the target engaging portion being at least a pair of target area flanges mounted to the rear face of the target area;

a target reset mechanism configured to operatively couple the target area flanges of the target engaging portion of the target device to the target connecting flanges of the target connecting mechanism of the target support system;

a support spring device encircling the target reset mechanism, the support spring device having a first end and a second end, the first end of the support spring device engaging the target device, the second end of the support spring device engaging the target support frame; and a latching device for selectively latching the target device, the latching device having an open position and a closed position and comprising an electrical drive system configured to switch the latching device between the open and closed positions.

12. The system of claim 11, wherein the target reset mechanism operates the target device between a raised position and a lowered position, wherein the target device is raised to a substantially vertical position with respect to the target support system in the raised position, and wherein the target device is lowered to a substantially horizontal position with respect to the target support system in the lowered position.

13. The system of claim 11, wherein the system has forward and rearward ends, the forward end facing against the projectile when the system is placed for shooting, and the rearward end opposite to the front end, and wherein the forward barrier includes a protection plate arranged at the forward end of the system and dimensioned to at least partially cover the target connecting mechanism from impact of the projectile on the system.

14. The system of claim 13, wherein the protection plate is made from an AR steel.

15. The system of claim 11, wherein the system has forward and rearward ends, the forward end facing against the projectile when the system is placed for shooting, and the rearward end opposite to the front end, and wherein the target supporting frame includes two leg portions connected at the rearward end and connected to the forward barrier so as to form a triangular shape.

16. The system of claim 11, wherein the target support system further includes a leveling mechanism configured to support the target support frame against the target placement area and stabilize the target support system on the target placement area.

17. The system of claim 11, wherein the target support system further includes a target damping mechanism configured to reduce collision impact and vibration caused by the target device that moves from a raised position to a lowered position after impact by the projectile, wherein the target device is raised to a substantially vertical position with respect to the target support system in the raised position, and wherein the target device is lowered to a substantially horizontal position with respect to the target support system in the lowered position.

18. The system of claim 1, further comprising a target retention mechanism selectively retaining the target device with respect to the target support system between a raised position and a lowered position, wherein the target device is raised to a substantially vertical position with respect to the target support system in the raised position, and wherein the target device is lowered to a substantially horizontal position with respect to the target support system in the lowered position.

19. The system of claim 11, further comprising a target retention mechanism selectively retaining the target device with respect to the target support system between a raised position and a lowered position, wherein the target device is raised to a substantially vertical position with respect to the target support system in the raised position, and wherein the target device is lowered to a substantially horizontal position with respect to the target support system in the lowered position.

* * * * *